United States Patent [19]

Larsson

[11] 4,427,155

[45] Jan. 24, 1984

[54] ADJUSTABLE SHOWER HEAD

[76] Inventor: Nils Larsson, Dalavägen 50, Västra Frölunda, Sweden, 400 72

[21] Appl. No.: 296,487

[22] Filed: Aug. 26, 1981

[30] Foreign Application Priority Data

Aug. 26, 1980 [SE] Sweden ..... 8005954

[51] Int. Cl.[3] ..... B05B 1/32

[52] U.S. Cl. ..... 239/460

[58] Field of Search ..... 239/460

[56] References Cited

U.S. PATENT DOCUMENTS 1,830,694 11/1931 Fraser ..... 239/460
2,756,108 7/1956 Warren ..... 239/460 X
3,116,880 1/1964 Kuiken .
3,403,860 10/1968 Shames et al. ..... 239/460
3,876,151 4/1975 Katva .

FOREIGN PATENT DOCUMENTS 2830201 1/1980 Fed. Rep. of Germany .

*Primary Examiner*—Andres Kashnikow
*Attorney, Agent, or Firm*—Holman & Stern

[57] ABSTRACT

A shower head comprising a hollow housing (2) for the passage of water, a sprinkle device mounted at the outlet end of the housing and a rotatable member (9) cooperating with the sprinkle device for adjusting the through flow area of the shower head.

9 Claims, 4 Drawing Figures

ADJUSTABLE SHOWER HEAD

BACKGROUND OF THE INVENTION

The present invention refers to a shower head comprising a hollow housing for the passage of water, a sprinkle device mounted at the outlet end of said housing and a rotatable member cooperating with said sprinkle device for adjusting the through-flow area of the shower head.

In view of increasing energy costs or in case of water shortage, it is desirable that the amount of water used when showering may be reduced without seriously deteriorating the shower effect. It is also desired that the shower pattern, in spite of a reduced amount of water, may be adjusted from consisting of many very thin "needle sharp" jets to a lesser number of turbulent jets with a massaging effect.

One problem in conventional shower heads where there is no possibility to adjust the through-flow area of the water within the shower head itself is that at a low rate of flow of the water the water will just flow out of the shower head without forming a bundle of jets.

Hand held showers with an adjustable shower head are previously known (e.g. U.S. Pat. No. 3,116,880) wherein the water flow may be adjusted and even completely closed off by means of a nut screwed onto the outer side of the shower head. This takes place by means of a valve body connected to said nut and moving towards and away from, respectively, the outlet end of the inlet conduit in the shower head and throttling the water flow to a larger or lesser degree. This design, however, does not solve the above mentioned problem since after the throttling the water will flow out into a larger space, being subjected to a reduction in pressure, before being distributed over the jet openings.

It is also known (through the U.S. Pat. No. 3,876,151) to obtain the closing of some of the jet openings by rotating a rotating member provided on the shower head. This will increase the velocity of the water through the remaining open jet openings even at low rates of flow. One drawback of this arrangement, however, is the reduction of the number of jet openings causing a reduced distribution of the water.

In another previously known adjustable shower head (German laid-open patent application No. 30 201) the nozzle plate is fixedly mounted and is surrounded by a rotatable member moveable towards and away from said plate so that an annular opening around the nozzle plate will be closed or opened. Adjustment of the water flow through the nozzle plate can be obtained only by increasing or decreasing the annular slot, which neither leads to a reduction of the water consumption nor to a positive change in the shower pattern.

THE OBJECT AND ESSENTIAL CHARACTERISTICS OF THE INVENTION

The object of the present invention is to provide a shower head of the kind mentioned hereinbefore, wherein a good shower effect with maintained distribution of the water may be obtained also with low rates of flow of the water. Another object of the invention is to provide the possibility of varying the shower jet in a simple manner from very fine "needle sharp" jets to a lesser number of more forceful turbulent jets. This has been attained in that said sprinkle device comprises an insert axially displaceable by said rotating member and comprising a number of plunger elements with increasing cross-sectional area in the direction of flow of the water, said plungers being displaceable each in an opening in the housing, said openings having a corresponding increase of the cross-sectional area in the direction of flow of the water, that said plungers and/or the walls of said openings are formed with channel-shaped grooves which form passages for the water between the housing and said plungers and that a sealing member is provided in each opening intended to seal against the respective plungers.

DESCRIPTION OF THE DRAWINGS

The invention will be more closely described herebelow with reference to the accompanying drawings.

DESCRIPTION OF THE EMBODIMENTS

Figure 1:
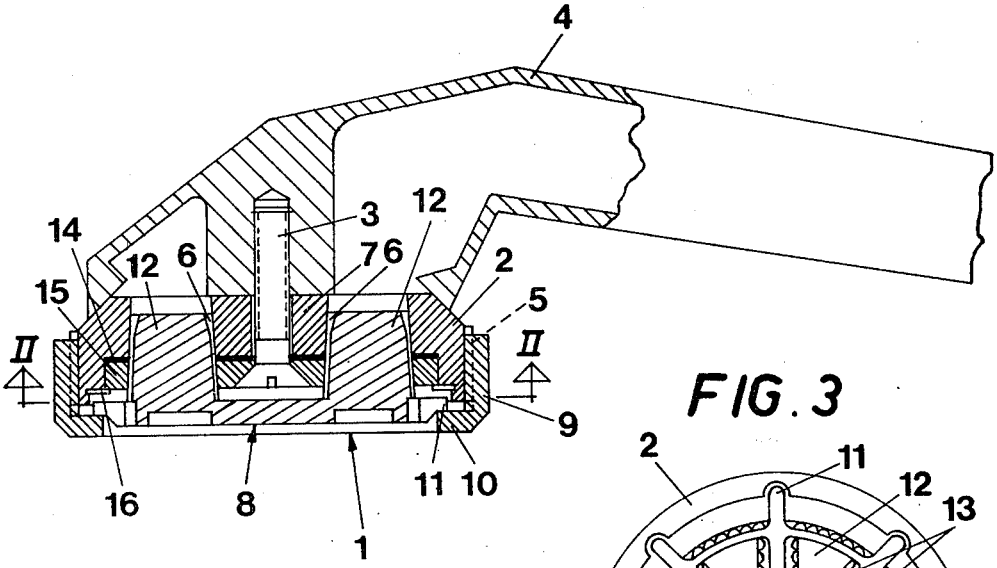
FIG. 1 is a section through a shower head according to the invention.
Figure 3:
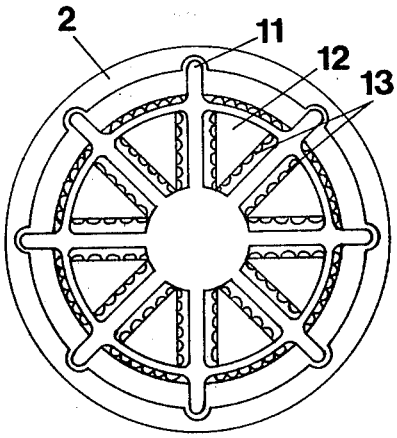
FIG. 3 is an end view of the shower head without the rotatable member.
Figure 2:
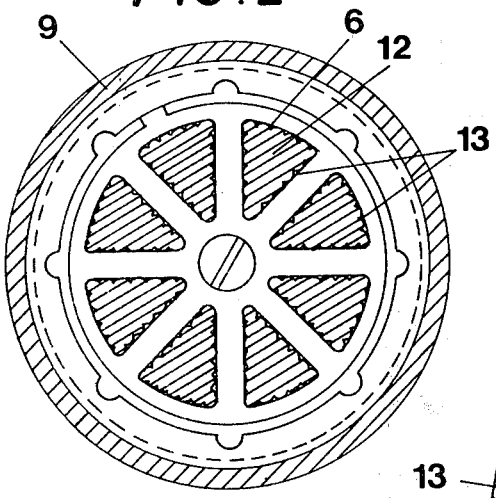
FIG. 2 is a section taken on the line II—II in FIG. 1.

The shower head 1 comprises a housing 2, which is fixedly mounted by means of a screw 3 to a hollow handle 4, which may be connected to a flexible supply conduit in conventional manner. The housing 2 has a cylindrical outer wall provided with external threads 5. A number of openings 6 with a sector-shaped cross-section extend axially through the housing 2 and are arranged uniformly around the middle portion 7 of the housing. The openings 6 have their pointed ends oriented towards said middle portion 7 and their cross-sectional area increases slightly in the direction towards the outlet end of the housing 2.

In the housing 2 there is provided an insert 8 which is retained by a nut 9 screwed onto the external threading of the housing and having an inwardly directed flange 10 abutting against radial projections 11 of the insert 8. The insert 8 is provided with a number of plunger elements 12 corresponding to the number of the openings 6, one plunger 12 being received in each of the openings 6. The elements 12 have a cross-sectional shape corresponding to that of the openings 6 and have a cross-sectional area which increases slightly in the direction of flow of the water. The plungers 12 may be brought to lie against the walls of the openings 6. The openings 6 and the plungers 12 may of course have any other cross-sectional shape and be positioned in other ways than what is shown in the drawing, which is only an example.

On the outer side of the piston-shaped plungers 12 there are formed channel-shaped grooves 13, which form passages for the water between the housing 2 and the insert 8. As an alternative, similar grooves may be arranged in the walls of the openings, or such grooves can be arranged both in the walls of the openings and on the outside of the plunger elements 12. The grooves 13 preferably have a decreasing depth and/or width in the direction of flow of the water. In the housing 2 there is provided a sealing washer 14 provided with openings corresponding to the openings 6 and adapted to seal against the plungers 12. The sealing washer 14 is retained against a shoulder in the housing 2 by means of a pressure plate 15 and a locking ring 16 outside of the plate 15. The sealing washer 14 prevents the passage of water between the housing 2 and the insert 8 in other places than through the groove channels 13, and when the insert is moved further into the housing the soft sealing material of the washer 14 may partly be pressed into the grooves 13, whereby the through- flow area for the water is further decreased. The reduction of the area obtained in this way may be sufficient even if the groove channels 13 have a uniform width and depth along their lengths.

The arrangement operates in the following manner. By tightening the nut 9 the insert 8 will be pressed inwardly in the housing 2, whereby the through-flow area for the water will be decreased. This will cause the velocity of the water in the shower head to increase. In order to decrease the water velocity, the nut 9 is rotated in the opposite direction, whereby the insert 8 will be pressed outwardly by the water as far as the position of the nut will allow. This will cause an increase of the through-flow area.

Thanks to this possibility of adjusting the velocity of the water jets in the shower head, the water consumption during showering may be reduced, since even at low rates of flow of the water it will be possible to obtain a sufficient velocity of the water jets and thereby the desired shower effect.

Figure 4:
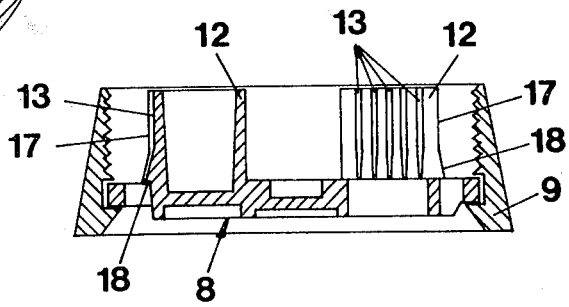
FIG. 4 is a section through a shower head according to a modified embodiment.

In the modified embodiment according to FIG. 4 the plunger elements 12 are formed, at their arcuate part 17, with a conical projection 18. The channel-shaped grooves 13 extend along said conical projection with a reduced depth and/or width. In the innermost position of the rotating member 9, in which very fine "needle-sharp" jets are obtained, the conical projections on the elements 12 will press against the pressure plate 15, which in turn will press against the sealing washer 14, which will thereby be pressed further against the elements 12 and partly into the grooves 13. In this position, the water consumption is as low as 3 liters/minute at normal supply pressure.

If the rotating member 9 is screwed slightly outwardly, the water flow increases and the jets from one and the same plunger 12 will coincide to form a "forceful" turbulent jet. In the fully open position-about two turns from the closed position-the water consumption is 18 liters/minute.

In the embodiment according to FIG. 4, the insert 8 is rotatably and axially non-displaceably mounted in the rotatable member 9.

The invention is not limited to the embodiments hereinbefore described and shown in the drawings, said embodiments being capable of modifications within the scope of the appended claims.

I claim:

1. In a shower head comprising a hollow housing for the passage of water, an adjustable sprinkler device mounted on the water outflow end of said housing, and adjusting means cooperating with said sprinkler for adjusting the through-flow area of the shower head, the improvement comprising:

a housing having a plurality of openings, each of which openings has an increase in its cross-sectional area in the direction of water outflow;

an insert member axially displaceably mounted downstream of said housing having a plurality of plunger elements corresponding to the housing openings, each of which plunger elements is displaceably inserted within a housing opening and each of which has an increasing cross-sectional area in the direction of water outflow;

channel-shaped grooves forming passages for water outflow between the housing and the insert, in the outer surface of the insert plunger elements and/or the inner surface of the insert openings, said grooves extending in the direction of water outflow;

flow adjustment means comprising a nut member rotatably mounted at the outflow end of said housing for axially displacing said insert member; and sealing means for forming a seal between the housing and the insert to prevent the passage of water through other than said channel-shaped grooves.

2. The improved shower head of claim 1 wherein the cross-sectional area of the channel-shaped grooves decreases in the direction of water outflow.

3. The improved shower head of claim 1 wherein said plunger elements and said housing openings are complementarily sector-shaped and have a common center coinciding with the axis of rotation of said flow adjustment means.

4. The improved shower head of claim 2 wherein said plunger elements and said housing openings are complementarily sector-shaped and have a common center coinciding with the axis of rotation of said flow adjustment means.

5. The improved shower head of claim 3 or 4 wherein each plunger element has an arcuate portion which has a conical projection increasing in the direction of water outflow and wherein the channel-shaped grooves extend along said projection with reduced cross-sectional area.

6. The improved shower head of claim 5 wherein the sealing means comprises a sealing washer provided between the wall of the outflow end of the housing and a pressure plate, which pressure plate is located downstream of the washer and cooperates with the conical projections of the plunger elements upon axial displacement of the insert member.

7. The improved shower head of any one of claims 1 through 4 wherein the flow adjustment means is a rotatable nut which is in threaded engagement with the outside wall of the housing and wherein the insert member is non-rotatably and non-axially displaceably fixedly mounted with respect to said nut.

8. The improved shower head of claim 5 wherein the flow adjustment means is a rotatable nut which is in threaded engagement with the outside wall of the housing and wherein the insert member is non-rotatably and non-axially displaceably fixedly mounted with respect to said nut.

9. The improved shower head of claim 6 wherein the flow adjustment means is a rotatable nut which is in threaded engagement with the outside wall of the housing and wherein the insert member is non-rotatably and non-axially displaceably fixedly mounted with respect to said nut.

* * * * *